US007587915B2

(12) United States Patent
Kaneda

(10) Patent No.: US 7,587,915 B2
(45) Date of Patent: Sep. 15, 2009

(54) SOCK

(75) Inventor: Masatoshi Kaneda, Koryo (JP)

(73) Assignee: Okamoto Corporation, Nara (JP)

( * ) Notice: Subject to any disclaimer, the term of this patent is extended or adjusted under 35 U.S.C. 154(b) by 0 days.

(21) Appl. No.: 12/289,135

(22) Filed: Oct. 21, 2008

(65) Prior Publication Data

US 2009/0100877 A1 Apr. 23, 2009

(30) Foreign Application Priority Data

Oct. 23, 2007 (JP) ..... 2007-274665

(51) Int. Cl.
*A41B 11/00* (2006.01)

(52) U.S. Cl. ..... 66/185; 2/239

(58) Field of Classification Search ..... 66/185, 66/186, 187, 188; 2/239–241
See application file for complete search history.

(56) References Cited

U.S. PATENT DOCUMENTS 2,050,535 A * 8/1936 Martel ..... 66/178 R
4,021,860 A * 5/1977 Swallow et al. ..... 2/239
4,149,274 A * 4/1979 Garrou et al. ..... 2/239
5,412,957 A * 5/1995 Bradberry et al. ..... 66/178 A
6,324,874 B2 * 12/2001 Fujimoto ..... 66/185
6,931,762 B1 * 8/2005 Dua ..... 36/9 R

FOREIGN PATENT DOCUMENTS

JP 3076702 1/2001
JP 3079355 5/2001

* cited by examiner

*Primary Examiner*—Danny Worrell
(74) *Attorney, Agent, or Firm*—Wenderoth, Lind & Ponack, L.L.P.

(57) ABSTRACT

A sock includes a sole having protrusions formed on its inner surface by tuck knitting. The protrusions are spaced from each other in the course direction to define first recesses between the protrusions that are adjacent to each other in the course direction, and spaced from each other in the wale direction to define second recesses between the protrusions adjacent to each other in the wale direction. Each protrusion is formed by knitting six courses in one loop, and includes six rubber threads, 12 reinforcing threads, three front threads and three back threads. The protrusions are arranged in a plurality of rows, each row occupying one course. Between the adjacent rows of protrusions, the second recesses are defined, which each occupy four courses. The protrusions have a height of 3.5 to 4.5 mm from the second recesses.

8 Claims, 6 Drawing Sheets

Before walking

Left foot:Sock for comparison

Right foot:Example 1

After walking

Left foot:Sock for comparison

Right foot:Example 1

SOCK

BACKGROUND OF THE INVENTION

I. Technical Field

This invention relates to a sock having a massaging effect.

II. Background Art

A sock of this type is disclosed in JP Utility Model Publication 3079355, which includes recesses and protrusions formed on the inner surface of its sole so that the protrusions contact predetermined points of the sole of the foot of the wearer.

The protrusions of conventional socks of this type are formed by tuck knitting with the adjacent protrusions spaced from each other in the course direction or wale direction, thereby defining recesses therebetween. In one arrangement, protrusions elongated in the course direction are spaced from each other in the wale direction. When forming the protrusions by tuck knitting, the larger the number of courses knitted in one loop, the higher the protrusions can bulge from the fabric and thus the higher the massaging effect (as disclosed in JP Utility Model Publication 3076702).

In view of the possibility of breakage of knitting needles, there is a limit to the number of courses that are knitted in one loop. But if the number of courses and the number of threads that are knitted in one loop are reduced, while it is possible to avoid the breakage of knitting needles, the hardness of the protrusions and the massaging effect tend to decrease, and also, the shape retainability of the protrusions may deteriorate. Sticking separate members on the inner surface of the sole complicates the manufacturing steps of the sock.

SUMMARY OF THE INVENTION

An object of the present invention is to form protrusions on the sole of a sock which are of sufficient hardness and height, and which can be formed easily, without the possibility of breakage of knitting needles.

In order to achieve this object, the present invention provides a sock comprising a sole having protrusions and recesses on an inner surface thereof, wherein the protrusions are formed by tuck knitting so as to be spaced from each other, thereby defining the recesses between the adjacent protrusions, each of the protrusions being formed by knitting a plurality of courses in one loop, and by knitting a rubber thread.

Specifically, by knitting a plurality of courses in one loop, it is possible to increase the height of each protrusion. By further knitting a rubber thread in each protrusion, the plurality of courses are pulled together in the course direction under the shrinkage force of the rubber thread. This further increases the height and hardness of the protrusions without the need to increase the number of courses knitted in one loop.

Thus, according to this invention, protrusions of sufficient hardness and height can be formed easily on the sole of the sock without the possibility of breakage of knitting needles.

BRIEF DESCRIPTION OF THE DRAWINGS

Other features and objects of the present invention will become apparent from the following description of the embodiment made with reference to the accompanying drawings, in which.

DETAILED DESCRIPTION OF THE INVENTION

Figure 1A:
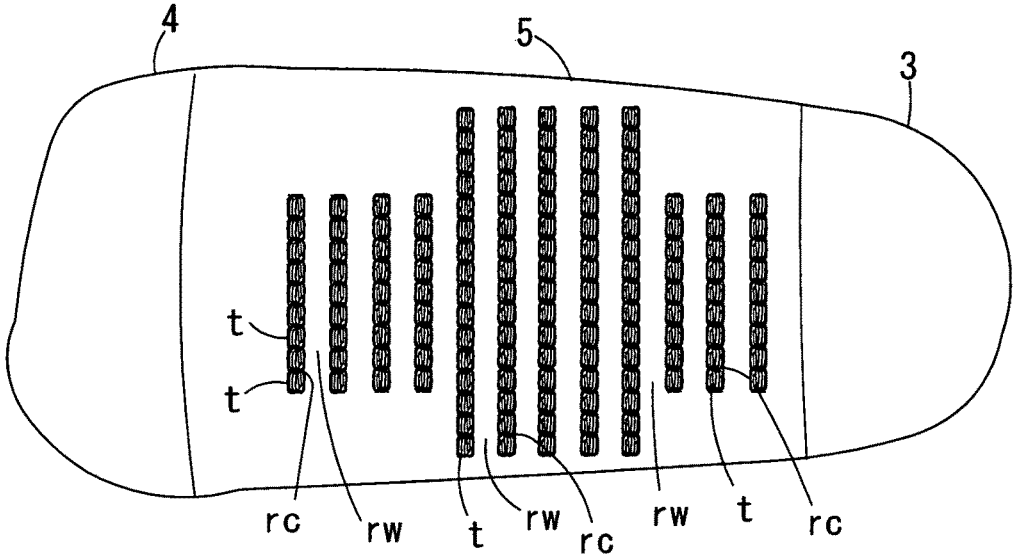
FIG. 1A is a plan view of the inner surface of the sole of a sock according to Example 1 of the invention.

The embodiments of this invention are now described.

The sock of the first embodiment comprises a sole having recesses and protrusions on the inner surface thereof. The protrusions are formed by tuck knitting. The protrusions are spaced from each other in the wale direction with the recesses defined between the adjacent protrusions. Each protrusion is formed by knitting a plurality of courses together in one loop. A rubber thread and a reinforcing thread are further knitted into each protrusion.

The reinforcing thread has higher rigidity than the front and back threads of the sock. Thus, by knitting the reinforcing thread, it is possible to increase the height and hardness of the protrusions, which in turn makes it possible to reduce the number of courses knitted into one loop.

The sock of the second embodiment has the recesses formed by rib knitting.

Loops in the spaces between the adjacent protrusions tend to expand under the shrinking force of the rubber thread in the course direction. Among plain knitting, rib knitting and purl knitting, rib knitting provides relatively high shrink properties in the course direction. In this embodiment, the recesses are formed by rib knitting, so that the loops of the recesses formed between the adjacent protrusions are expanded to the limit. This ensures firm contact between the protrusions and the sole of the foot, and thus sufficient massaging effect.

Also, according to this embodiment, because the recesses are formed by rib knitting, which provides high air permeability, and because the adjacent protrusions are spaced apart from each other, thereby forming the recesses therebetween, the sock according to this embodiment has far higher air permeability in the horizontal direction over the entire area where the protrusions and recesses are formed, compared to conventional socks. Thus, the sock according to this embodiment exhibits excellent and long-lasting massaging effect and also prevents tackiness resulting from sweating.

In the third embodiment, each protrusion is formed by knitting a plurality of rubber threads, reinforcing threads and front and back threads.

Unlike ordinary tucks, which are formed by knitting a plurality of front and back threads, the protrusions of the sock according to this embodiment are formed by knitting a plurality of rubber threads and reinforcing threads in addition to a plurality of front and back threads, protrusions that are higher and harder than conventional such protrusions can be formed by knitting only.

The sock of the fourth embodiment is one specific variation of the third embodiment, in which each protrusion is formed by knitting six courses in one loop and comprises six rubber threads, 12 reinforcing threads, three front threads and three back threads.

In knitting a sock using a knitting machine, the larger the numbers of courses and threads knitted in one loop, the more likely the knitting needles are to be broken. Taking this fact into consideration, in this embodiment, the protrusions are constructed of the above-mentioned numbers and types of threads. With this arrangement, the rubber threads and the reinforcing threads ensure suitable height and hardness of the protrusions even though the number of courses knitted in one loop is limited to the above-mentioned number. Because the number of courses knitted in one loop is small, it is possible to reliably prevent breakage of knitting needles.

The sock according to the fifth embodiment has protrusions having a height of 3.5 to 4.5 mm from the recesses. By knitting 24 threads in one loop as in the fourth embodiment, it is possible to form protrusions having a height within this range.

According to the sixth embodiment, the protrusions and recesses are arranged in a plurality of rows, each row occupying one course, and a recess is defined between any adjacent rows so as to occupy four courses.

By forming high and hard protrusions using 24 threads as in the fifth embodiment, such protrusions are less likely to be crushed under the pressure from the foot. But the harder the protrusions, the more likely the protrusions are to cause pain in the sole of the foot of the wearer due to high contact pressure between the protrusions and the foot. It was discovered that by arranging the protrusions and recesses in the above-described pattern, it is possible to maximize the massaging effect without causing pain in the foot.

In the seventh embodiment, Dry Release (Registered Trademark) made by Fujibo Holdings, Inc. is used for the front threads.

The larger the number of threads forming the protrusions, the larger the amount of sweat absorbed in the protrusions, and thus the more likely the protrusions are to stick to the sole of the foot. But since Dry Release has a higher ability to absorb sweat and dries more quickly than cotton threads, by using Dry Release (Registered Trademark) instead of cotton threads for the front threads, sweat in the protrusions can quickly and smoothly migrate onto the outer surface of the sock. This prevents sticking of the protrusions to the foot. Needless to say, for quicker and smoother migration of sweat, front threads are preferably knitted into the protrusions.

The sock according to the eighth embodiment has an instep formed by moss knitting. (i.e., alternately taking in the course direction and the wale direction).

In order to arrange the protrusions and recesses at the portion of the sock corresponding to the ball of the foot, which is ordinarily the main massaging area, the protrusions and recesses have to be arranged on the sole of the sock which is formed by wales which connect the toe with the heel. In the case of a sock formed by circular knitting machine, its sole, which is formed by wales connecting the leg portion with the toe, has as many courses as the sole. Loops of the sole tend to shrink when a plurality of courses of the sole are knitted in one loop. This may lead to a large difference in length and stretchability between the instep and the sole, which may in turn make it difficult to maintain the sock's inherent shape. By forming tucks in the instep too, this is prevented.

EXAMPLE 1

Figure 1B:
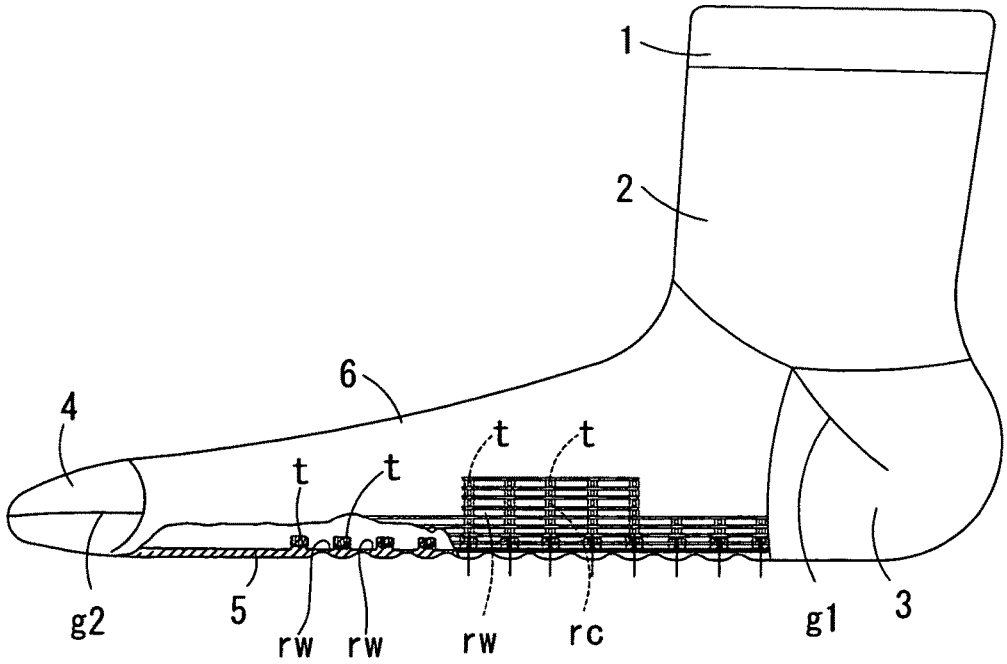
FIG. 1B is a side view of the sock of Example 1 of the invention, wherein the sole is partially cut away to show its inner portion.

As shown in FIGS. 1A and 1B, the sock according to Example 1 comprises a rubber mouth portion 1, leg portion 2, heel 3, toe 4, sole 5 and instep 6. The sole 5 is the area under the wale connecting the intersection between a gore line g1 formed when knitting the heel 3 and the leg portion 2 with the intersection between a gore line g2 formed when knitting the toe 4 and the instep 6. The area over this wale is the instep 6.

Figure 3A:
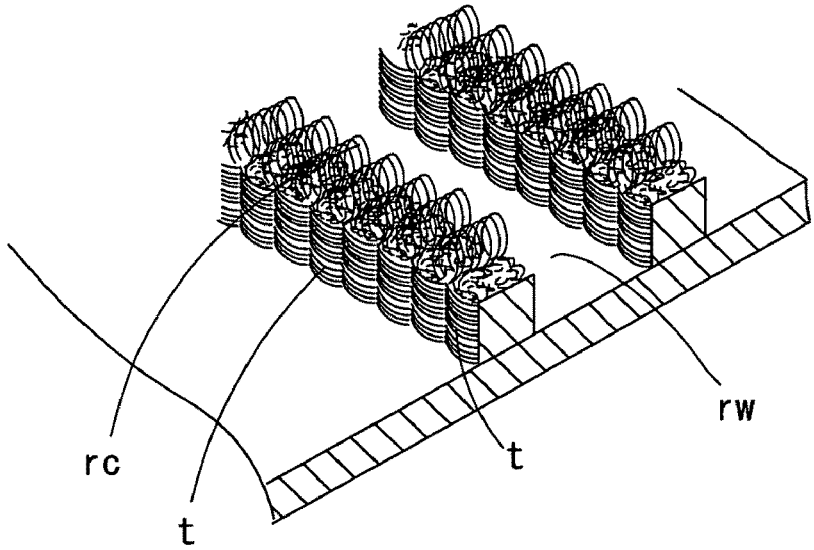
FIG. 3A is a partial enlarged perspective view of the sock of FIG. 1, showing its protrusions.
Figure 3B:
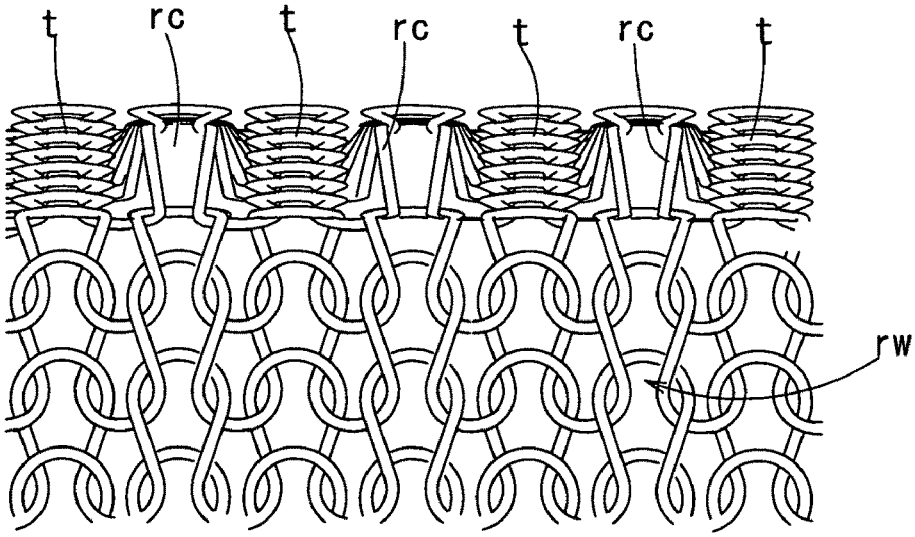
FIG. 3B is a partial enlarged view of the sock of FIG. 1, schematically showing its protrusions as viewed from the top.

FIG. 3B is a partial enlarged view of the sock of FIG. 1, schematically showing its protrusions as viewed from the top The sock according to Example 1 has protrusions t and recesses rc and rw on the inner surface of the sole 5. The protrusions t are arranged in a plurality of rows, each row extending in the course direction. The recesses rw are defined between the respective adjacent rows of protrusions. Each recess rw comprises four courses. Thus, the protrusions and recesses form a gridiron pattern as a whole. Each row of protrusions occupies a single course. Since the protrusions and recesses are arranged in a gridiron pattern with the adjacent rows of protrusions extending parallel to each other while being spaced from each other in the wale direction, air permeability in the horizontal direction is higher than socks with protrusions and recesses that are arranged in a corrugated or staggered pattern. Considering the fact that the higher and harder the protrusions, the lower the air permeability in the horizontal direction, the abovementioned gridiron pattern can be said to be an ideal pattern.

The rows of protrusions at the arch of the foot are longer in the course direction than those at the ball of the foot. The protrusions t and recesses rc and rw may be arranged in a different manner according to the portion or portions of the foot where the highest massaging effect is desired. Similar protrusions and recesses may also be formed on the heel 3, toe 4 and/or any other portion of the sock.

The sole 5 and instep 6 comprise courses c1 each including a single front thread and courses c2 each including a single back thread. The sole 5 is formed both by rib knitting and tuck knitting.

Figure 2:
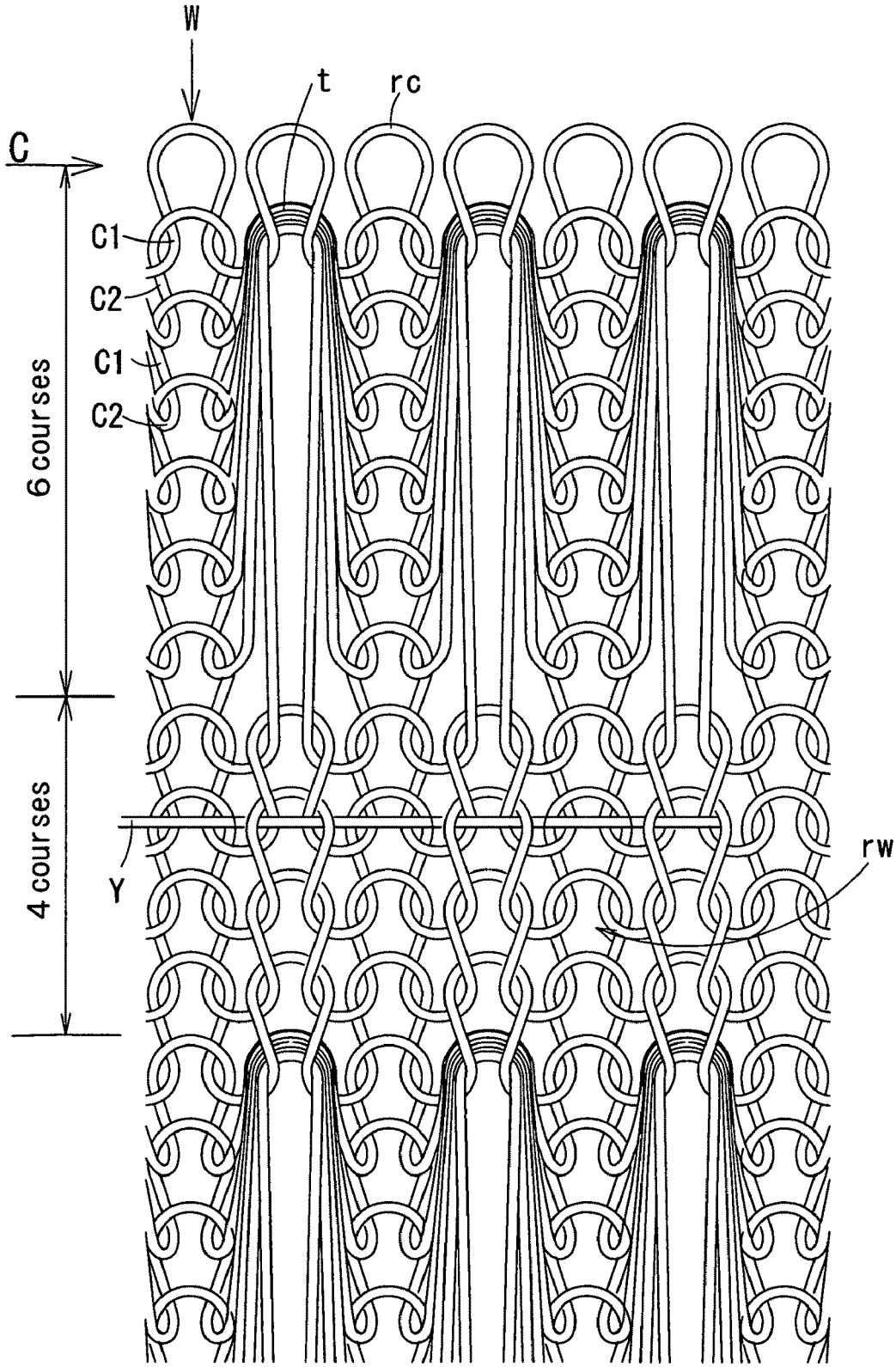
FIG. 2 schematically shows protrusions and recesses of FIG. 1, illustrating how the protrusions and recesses are formed by knitting.

FIG. 2 shows how the protrusions t and recesses rc and rw are formed by knitting. FIG. 3A is a partial enlarged perspective view of the sole 5, showing portions of the protrusions t and recesses rc and rw. FIG. 3B is a partial enlarged plan view of the sole 5, showing portions of the protrusions t and recesses rc and rw.

As shown in FIGS. 2, 3A and 3B, the recesses rc and rw are formed by rib knitting with no tucks, while the protrusions t are formed by tuck knitting, which is a modification of rib knitting.

Each protrusion t is formed by knitting six courses together in a single loop. That is, each protrusion t comprises three courses each including a front thread and three courses each including a back thread.

Each of the courses c1 and c2 also includes one rubber thread and two reinforcing threads, which are collectively indicated by Y in FIG. 2. (Although the thread group Y is shown only in one course in FIG. 2, and not shown at all in FIG. 3B for simplicity of these figures, it is to be understood that every course includes such thread group Y.) Thus, each protrusion t includes six rubber threads and 12 reinforcing threads.

That is, each protrusion t, which is formed by knitting six courses together in a single loop, is made up of six rubber threads, 12 reinforcing threads, three front threads, and three back threads.

For the front threads, "DRY RELEASE" (registered trademark) may be used. For the back threads, XION (registered trademark) may be used. For the rubber threads, MARULON (registered trademark) may be used. For the reinforcing threads, polyester thread 150D may be used.

The adjacent protrusions t in each row are spaced from each other by one wale in the course direction C. The adjacent rows of protrusions are spaced from each other by four courses in the wale direction W. Since the protrusions t are spaced from each other in the course direction C and the wale direction W, the plurality of tucked courses can be more easily pulled together under the circumferential shrinking forces of the rubber threads and the fabric, without being hindered by the fabric around the tucks. This serves to increase the height and hardness of the respective protrusions t.

The portions between the adjacent protrusions t in each row are crushed under the above shrinking forces. Thus, loops protrude, thereby forming the recesses rc, which are slightly lower in height than the protrusions t, between the adjacent protrusions t. Between the adjacent rows of protrusions t, which are spaced from each other by four courses in the wale direction C, the recesses rw are formed, which are lower than the recesses rc and at the same level as the base fabric of the sock.

The leg portion 2 and the instep 6 are formed by moss knitting in order to compensate for any difference in length or shrinkage factor between the sole 5 and the instep 6 due to shrinkage of loops of the sole 5.

The heel 3 and the toe 4 are formed by pile knitting to adapt to e.g. walking.

Figure 4:
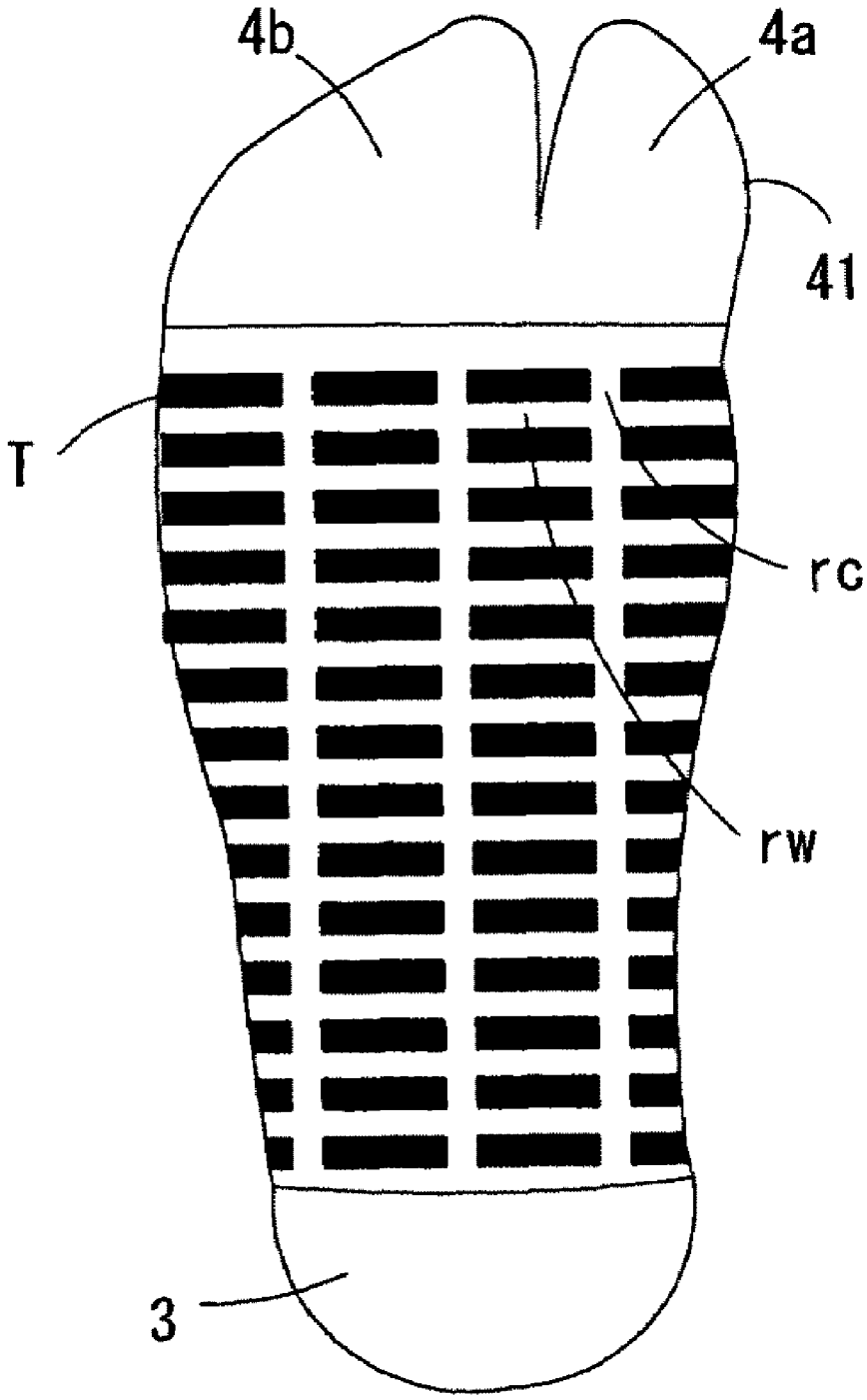
FIG. 4 is a plan view of a different example of the invention.

The protrusions and recesses may be arranged in a pattern different from the pattern of the Example 1. For example, they may be arranged in a pattern as shown in FIG. 4, in which the protrusions and recesses are arranged in a matrix pattern over the entire surface of the sole between the heel 3 and the toe 41. Specifically, the recesses rc and rw form a lattice pattern, and the protrusions t disposed along each course are sufficiently separated from each other.

The sock according to the present invention is not limited in shape and type to the sock of Example 1. For example, the sock shown in FIG. 4 has a toe 41 which is separated into a first pocket 4*a* for receiving the first toe and a second pocket 4*b* for receiving the other toes, as is typical with Japanese socks.

For socks having protrusions and recesses according to Example 1 arranged in different patterns, tests for evaluating the massaging effect, feel of wear and air permeability were conducted.

[Sole Pressure Test]

For test socks each having rows of protrusions t and recesses rc, each row occupying one course, and recesses rw each occupying a predetermined number of courses which is different from the corresponding numbers in the other socks, their respective pressure distributions were determined. The test was conducted in the following order.

1) Each test sock is put on a flat (wooden) last.
2) In interior space, a plate is placed on a carpet, and a sensor of an F-SCAN tester (made by Nitta Corporation) is placed on the plate.
3) Each sock, which is put on the last, is placed on the sensor, and a 10 kg weight is put on the metatarsal portion.

Figure 5:
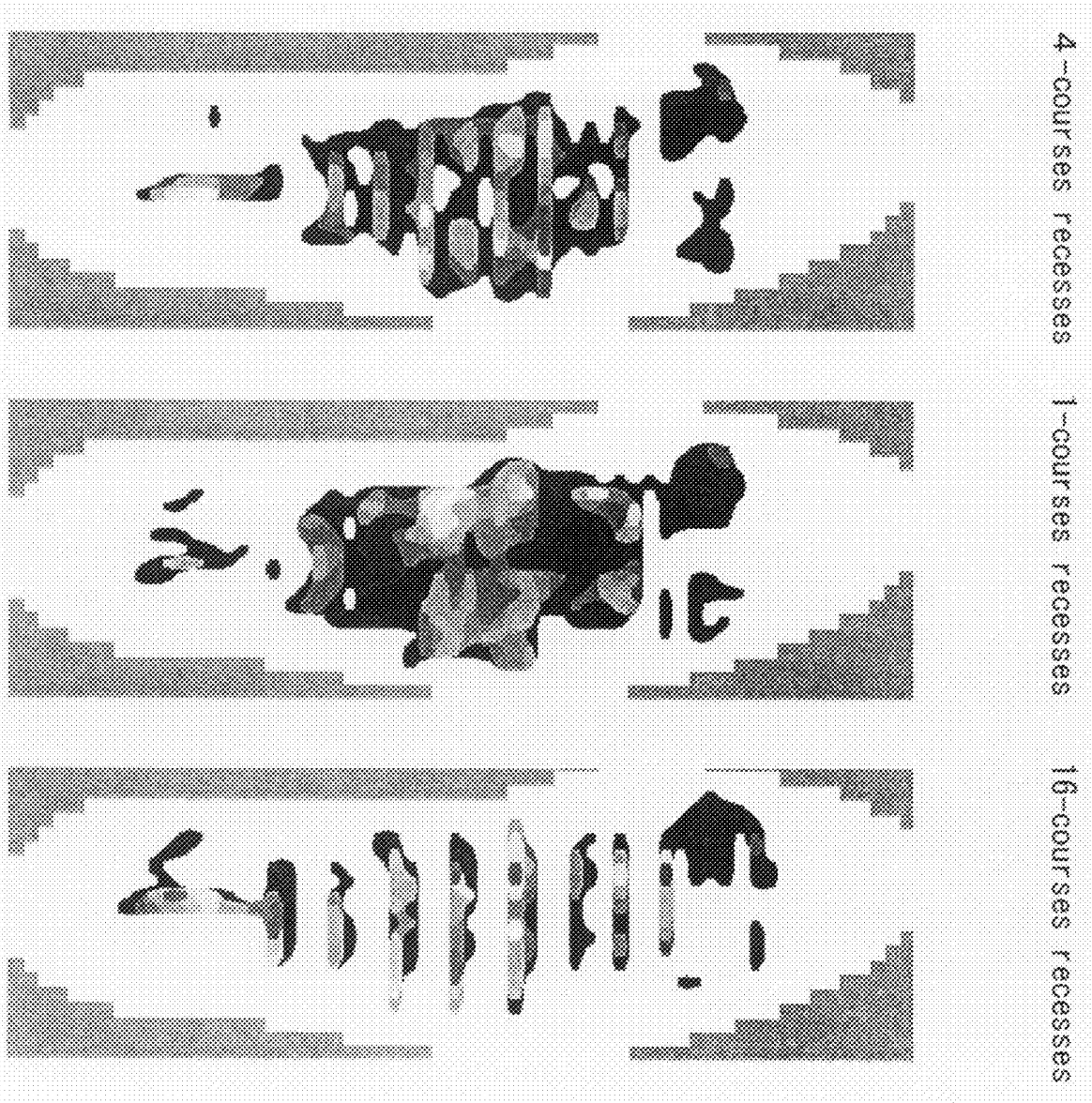
FIG. 5 shows the results of a sole pressure test.

Table 1 shows the maximum contact pressure for each sock, and FIG. 5 shows the pressure distribution for each sock.

TABLE 1

| Test sock | Recesses rw each occupying four courses | Recesses rw each occupying one course | Recesses rw each occupying 16 courses |
|---|---|---|---|
| (kPa) | 76.0 | 51.0 | 91.0 |

In the sole pressure test, the sole pressure varies with the structures and areas of the protrusions and recesses. Because the load (10 kg) is constant, stress is concentrated on the protrusions t when the sole touches the floor, so that the contact pressure is partially high. Thus, if the area ratio of the rows of protrusions to the entire sole is too low, the contact pressure and the stimulation to the foot tend to be so high as to cause pain in the foot of the wearer. Conversely, if the area ratio of the rows of protrusions to the entire sole is too high, the contact pressure and the stimulation to the foot tend to be so low that no sufficient massaging effect is obtained.

For the recesses each occupying one course, the maximum contact pressure is low, and the pressure distribution of the protrusions and recesses is such that the pressure is not clearly high along the rows of protrusions. Thus, this arrangement is not suitable for massaging the sole of the foot.

For the recesses each occupying 16 courses, the contact pressure is markedly high along the rows of protrusions. But the maximum contact pressure along the rows of protrusions is so high that it is considered, from experience, that too much stimulation will be given to the sole of the foot. Thus, this arrangement is also not suitable for massaging the sole of the foot.

For the recesses each occupying four courses, contact pressure is produced over the entire recesses and protrusions. The maximum contact pressure along the rows of protrusions is considered, from experience, to be such a value as to give suitable stimulation to the sole of the foot. Thus, the arrangement of Example 1 of the invention, which includes rows of protrusions each occupying one course, and recesses defined therebetween and occupying four courses, is considered to be suitable for massaging the sole of the foot.

[Compression Property Test]

For test cloths each including rows of protrusions t according to Example 1 each occupying a predetermined number of courses which is different from the corresponding numbers in other cloths, the height of the protrusions t (from the recesses rw) and their hardness were measured. The test was conducted in the following order.

Tester: KES-FB System made by Kato Tech Co., Ltd. (Nara Prefectural Institute of Industrial Technology)

Test conditions: Knit high-sensitivity measurement (measurement of absolute cloth thickness at 10 gf/cm$^2$ and 50 sec/mm).

1) Each of the test cloths formed with protrusions and recesses is cut to a 10 cm square piece (or to such a size that a sensor can be placed thereon) and set in a measuring instrument, and measurement is made.
2) For each test cloth, measurements were made at three different points, and the average of the three measured values was calculated.

TABLE 2

| Test cloth | LC | WC | RC | T0 | TM |
|---|---|---|---|---|---|
| Example 1 of the invention (6-course tucks) | 1.39 | 0.17 | 38.90 | 4.01 | 3.19 |
| Comparative Example 1 (2-course tucks) | 1.22 | 0.27 | 42.13 | 2.63 | 2.17 |
| Comparative Example 2 (5-course tucks) | 1.27 | 0.21 | 37.50 | 3.45 | 2.65 |

The lower the LC value, the softer the initial compression properties of the protrusions t. The higher the WC value, the softer the protrusions t. The higher the RC value, the better the recoverability of the protrusions t after removing the load. The higher the T0 value, the larger the height of the protrusions t from the recesses rw. The higher the TM value, the less likely the protrusions are to be crushed.

As is apparent from Table 2, the protrusions t of Example 1 of the invention have the largest heights (T0 value and TM value), and the least likely to be crushed (LC value and WC value). Thus, the protrusions t of Example 1 of the invention have the largest height and hardness, and thus can most effectively stimulate the sole of the foot. Also, while the protrusions t of Example 1 of the invention are hardest, that is, have sufficiently high WC and TM values compared to the minimum required values, their recoverability (RC value) is not very low.

[Results of a Ventilation Test]

Air permeability of the protrusions and recesses of Example 1 of the invention in the horizontal directions was tested. The test was conducted in the following order.

Tester: Frajour ventilation tester (made by Unitica-Garmentech)

1) Each test cloth was held in a test jig formed of acrylic plates, and the jig was set vertically in the Frajour type ventilation tester.
2) Air permeability of the test cloth in the horizontal direction was measured.
3) This measurement was made twice, and the average of the two measured values was calculated.

Table 3 shows the results of the horizontal ventilation test for cloths having knitting structures employed in ordinary socks, and the test cloth according to Example 1 of the invention.

TABLE 3

| Knitting structure | Air permeability |
|---|---|
| Plain portion | 0.16 |
| Pile portion | 0.40 |
| Mesh portion | 0.24 |
| Example 1 of the invention | 8.10 |

While air permeability of the cloths having knitting structures employed in ordinary socks was in the range of 0.16 to 0.4 ($cm^3$/sec), the air permeability of the protrusions and recesses according to Example 1 of the invention was 8.10 ($cm^3$/sec) and higher than the former in the horizontal direction by about 20 times. Thus, it is considered that the sock according to Example 1 of the invention can efficiently promote ventilation, thus reducing dampness.

[Test for the Rate of Water that Migrates into Contact with Skin]

Moisture migration properties, which influence the sticky feeling resulting from wetting of the sock according to Example 1 of the invention, were measured. The test was conducted in the following order.

1) 0.2 g of water was applied to the surface of each test article which contacts the skin of the foot at one point thereof.
2) After the water had been absorbed, a load was applied to the sock with filter paper in contact with the article to allow water to migrate into the filter paper.
3) By weighing the filter paper, the rate of water that had migrated into the filter paper was calculated.

Water migration rate (%)=(Increased amount of the filter paper/0.2)×100

Table 4 shows the results of the test conducted for an ordinary sock formed by plain knitting and the sock according to Example 1 of the invention.

TABLE 4

| Test article | Moisture migration rate |
|---|---|
| Example 1 of the invention | 2.1 |
| Sock formed by plain knitting (C100) | 20.5 |

The moisture migration rate is 2.1 (%) for the sock according to Example 1 of the invention, and 20.5 (%) for the sock formed by plain knitting. Thus, the rate of water that migrates into contact with skin is significantly lower with Example 1 of the invention. This indicates that even if the sock according to Example 1 of the invention becomes wet with sweat, the wearer is less likely to feel wet but feels dry.

[Results of a Test on Hot and Dry Feel to the Touch]

The feel of wear of and the dry feel of each test sock were tested. The test was conducted in the following order.

Measuring machine: Thermo-Labo type II (made by Unitica-Garmentech)

Test conditions: Environment: 20° C. 65% RH ΔT=10° C.

1) Using a Thermo-Labo type II tester, a copper plate of which the heat capacity is known was heated to 30° C., which is higher than the temperature of the test specimens.
2) The maximum temperature change of the copper plate was measured when each test specimen was brought into contact with the copper plate, and the consumed calorie was calculated from the measured value.

Table 5 shows the test results for an ordinary plain knitted sock and Example 1 of the invention.

TABLE 5

| Test conditions (Environment: 20° C. 65% RH ΔT = 10° C.) | Example 1 of the invention | Plain sock |
|---|---|---|
| Dry condition | 0.026 | 0.078 |
| 100% wet condition | 0.077 | 0.136 |

The sock according to Example 1 of the invention gives a lesser cold feel to the touch than the ordinary plain knitted sock. In a dry condition, cold feel to the touch was 0.026 ($W/cm^2$) for the sock according to Example 1 of the invention, and 0.078 ($W/cm^2$) for the plain knitted sock. In a 100% humidity condition, cold feel to the touch was 0.077 ($W/cm^2$) for the sock according to Example 1 of the invention, and 0.136 ($W/cm^2$) for the plain knitted sock. These results show that the sock according to Example 1 gives a lesser cold and thus wet feel to the touch. The wet feel to the touch for the sock according to Example 1 in a 100% humidity condition is substantially the same as the wet feel to the touch for the plain knitted sock in a dry condition. This indicates that the sock according to Example 1 gives a less wet feel and thus a dry feel to the touch even when the sock is wetted with sweat.

[Thermograph]

In order to examine the massaging effect of the sock according to Example 1 of the invention, the temperature change of the sole of the foot was measured before and after wearing each test sock. The massaging effect to the sole of the foot can be determined by measuring the degree of improvement in blood circulation. The blood circulation can be in turn calculated based on the degree of temperature rise. Thus, any temperature rise of the sole of the foot after wearing the sock indicates that the sock provides a massaging effect. The test was conducted in the following order.

Measuring machine: Thermograph TH71-707 made by NEC Sanei

Measurement environment: Temperature 20° C., Relative humidity 65%

(constant temperature, constant humidity chamber)

1) With the sock according to Example 1 of the invention (1-course protrusions and four-course recesses) worn on the right foot of each of three test subjects, and an all-pile sock (of which the entire sole is formed by pile knitting) for comparison worn on the left foot, thermography was carried out.
2) Each test subject walked on a treadmill at 4 km/hour for 10 minutes.
3) The test socks were taken off, and thermography was carried out immediately thereafter.
4) The average temperatures were measured for the entire soles of the right feet and the entire soles of the left feet of the three subjects, respectively.

Figure 6A:
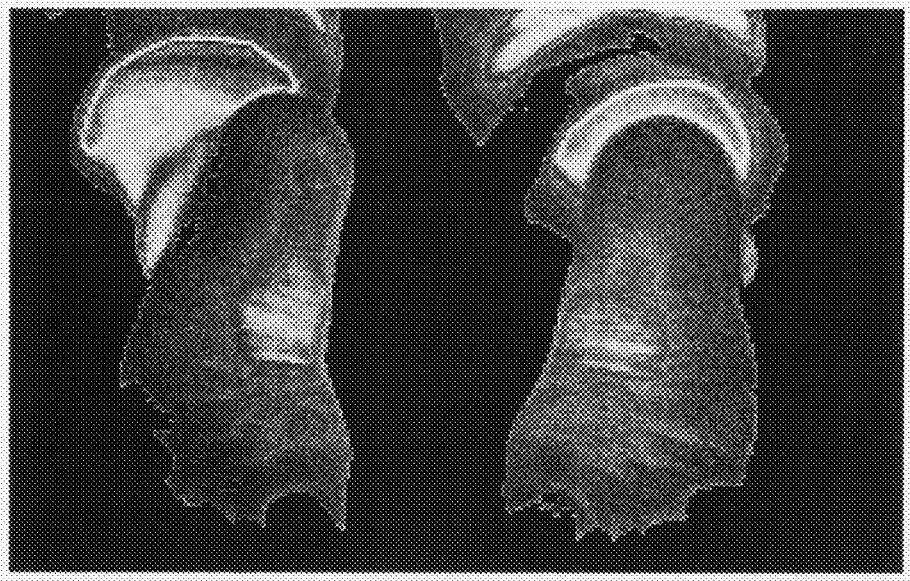
FIGS. 6A and 6B show the results of a thermograph test.
Figure 6B:
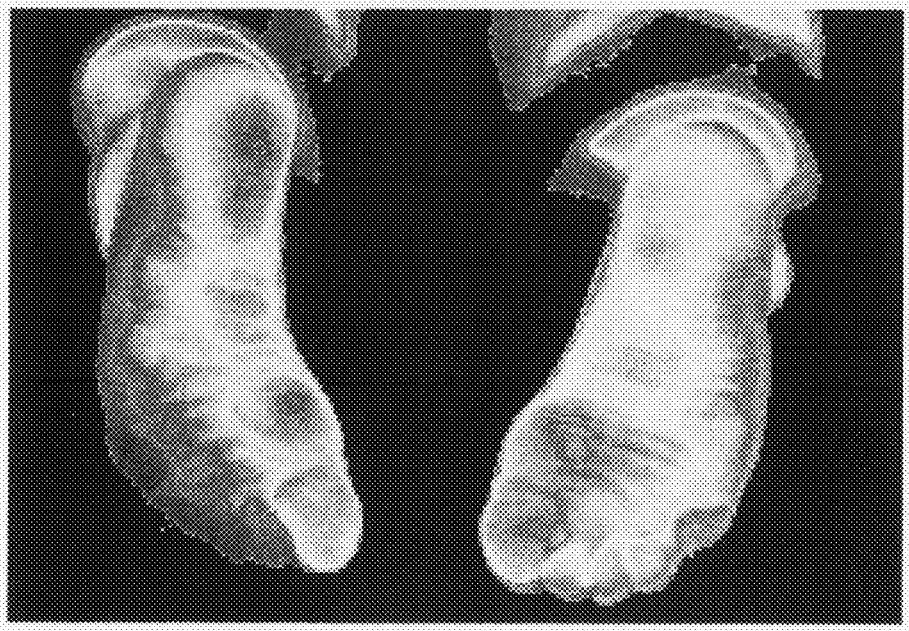

Table 6 shows the test results. FIGS. 6A and 6B show thermographs of one of the test subjects in items 1) and 3), respectively. Similar thermographs were obtained for the other two test subjects too.

TABLE 6

| Test subject | Test sock | Average temp before wearing | Average temp after wearing |
|---|---|---|---|
| A | (Right foot) Example 1 of the invention | 24.23 | 27.79 |
| | (Left foot) Sock for comparison | 24.17 | 26.97 |
| B | (Right foot) Example 1 of the invention | 27.58 | 28.03 |
| | (Left foot) Sock for comparison | 27.54 | 27.41 |
| C | (Right foot) Example 1 of the invention | 27.46 | 27.10 |
| | (Left foot) Sock for comparison | 27.34 | 26.93 |
| Average | Average of three (right foot) Example 1 of the invention | 26.42 | 27.6 |
| | Average of three (left foot) sock for comparison | 26.35 | 27.1 |

Table 6 shows that for any of the test subjects, the temperature of the sole of the foot increased at a higher rate (or decreased at a lower rate) when the sock according to Example 1 of the invention was worn than when the sock for comparison was worn. Thus, it is apparent that the sock according to Example 1 of the invention provides a higher massaging effect than the sock for comparison.

FIGS. 6A and 6B indicate that the sole of the right foot, on which the sock according to Example 1 of the invention is worn, has a wide area where the temperature is high, including its ball and arch. Thus, it is apparent that the sock according to Example 1 of the invention provides a higher massaging effect over a wider area of the foot than the sock for comparison.

What is claimed is:

1. A sock comprising:

a sole comprising a plurality of courses extending in a course direction, each of said courses comprising a loop-forming yarn having a plurality of loops, a rubber yarn and a reinforcing yarn, an inner surface, and protrusions and recesses on said inner surface, said protrusions being formed so as to be spaced from each other in the course direction, thereby defining said recesses between adjacent protrusions, each of said protrusions being formed by tuck knitting, wherein said plurality of courses includes a first course and a second course, said first course including a first loop-forming yarn having a first plurality of loops including a plurality of first loops and a second loop, a first rubber yarn and a first reinforcing yarn, said second course including a second loop-forming yarn having a second plurality of loops including a plurality of first loops and a second loop, a second rubber yarn and a second reinforcing yarn, said plurality of first loops from said first plurality of loops being pulled toward said second loop-forming yarn and knitted to form said second loop of said second plurality of loops, and wherein together with said first rubber yarn and said first reinforcing yarn, said first loops from said first plurality of loops are substantially aligned with each other and with said second loop of said second plurality of loops in a wale direction perpendicular to the course direction.

2. The sock of claim 1 wherein said recesses are formed by rib knitting.

3. The sock of claim 2 wherein each of said protrusions are formed by knitting together a plurality of rubber threads, reinforcing threads, front threads and back threads.

4. The sock of claim 3 wherein each of said protrusions are formed by knitting six courses in one loop and comprises six rubber threads, 12 reinforcing threads, three front threads, and three back threads.

5. The sock of claim 4 wherein each of said protrusions has a height of 3.5 to 4.5 mm from said recesses.

6. The sock of claim 5 wherein said protrusions are arranged in rows, each row occupying one course, said rows of protrusions being spaced apart from each other by four courses, thereby defining said recesses therebetween, each recess occupying four courses.

7. The sock of claim 1 further comprising an instep having the course direction and the wale direction alternately tucked.

8. The sock of claim 2 wherein the loop-forming yarns are configured to pull the courses together in the course direction via a shrinking force, so as to increase the height and hardness of said protrusions.

* * * * *